US006915604B2

(12) United States Patent
Haywood

(10) Patent No.: US 6,915,604 B2
(45) Date of Patent: Jul. 12, 2005

(54) HOLIDAY DISPLAY BOX WITH MOVEABLE FIGURINES

(76) Inventor: Steve Haywood, 9529 S. Greenwood Ave., Chicago, IL (US) 60628

( * ) Notice: Subject to any disclaimer, the term of this patent is extended or adjusted under 35 U.S.C. 154(b) by 211 days.

(21) Appl. No.: 10/155,339

(22) Filed: May 24, 2002

(65) Prior Publication Data

US 2003/0217492 A1 Nov. 27, 2003

(51) Int. Cl.[7] ..... G09F 19/08

(52) U.S. Cl. ..... 40/414; 40/415; 40/597; 428/13

(58) Field of Search ..... 40/411, 414, 415, 40/427, 429, 597, 594; 428/7, 13; 446/83, 236; 434/393

(56) References Cited

U.S. PATENT DOCUMENTS

| | | | | | |
|---|---|---|---|---|---|
| 2,241,182 | A | * | 5/1941 | Cayo | 428/13 |
| 4,177,592 | A | | 12/1979 | Ruck | |
| 4,546,019 | A | * | 10/1985 | Schneider | 428/13 |
| 4,838,825 | A | | 6/1989 | Hwang et al. | |
| 5,234,728 | A | * | 8/1993 | Chiang | 428/13 |
| 5,303,490 | A | * | 4/1994 | Yang | 40/414 |
| 5,345,153 | A | | 9/1994 | Vaught | |
| 5,412,890 | A | | 5/1995 | Fechter | |
| 5,423,140 | A | * | 6/1995 | Nuspl | 40/597 |
| 5,682,692 | A | | 11/1997 | Huang | |
| 5,713,776 | A | | 2/1998 | Hou | |
| 5,870,842 | A | * | 2/1999 | Ogden et al. | 40/411 |
| 5,915,853 | A | | 6/1999 | Guilin | |
| 5,980,356 | A | | 11/1999 | Meng-Suen | |
| 6,038,803 | A | * | 3/2000 | Wilkins | 40/594 |
| 6,192,215 | B1 | | 2/2001 | Wang | |
| 6,312,308 | B1 | | 11/2001 | Chen | |

* cited by examiner

*Primary Examiner*—Gary C. Hoge
(74) *Attorney, Agent, or Firm*—JoAnne M. Denison; Denison & Assocs, PC

(57) ABSTRACT

The present invention consists of an illuminated, musical display box having removable character elements mounted on pins and a removable scenic background, which character elements are capable of moving in a pleasing fashion about the rear wall of the device and/or on a lower platform of the device. The motion display box is substantially upright and narrow in configuration such that it can easily be installed onto the interior portion of a standard home window to be seen from the outside of the house during a given holiday season. The device may be provided with a speaker and an electronic tune generating chip embodied in a removable module or housing. Since the characters, background and music module may be easily and conveniently changed out by the user as the seasons change or the interior contents may be desired to be updated, one musical display box may be used through several holiday season changes.

13 Claims, 2 Drawing Sheets

HOLIDAY DISPLAY BOX WITH MOVEABLE FIGURINES

FIELD OF THE INVENTION

The present invention relates to the field of animated display units, and more specifically those which are adapted to fit within the standard home window frame conveniently so that they may be easily removably installed during the appropriate holiday season.

BACKGROUND OF THE INVENTION

Currently, in the marketplace, there are available a wide variety of animated display devices which are intended for amusement purposes. Some of the most popular devices include horizontally oriented devices which include a plurality of skating figures which appear to move like magic over a smooth miniature ice pond. Such animated skating figures are driven by means of magnets inserted in a base on each figure which is in turn driven by corresponding magnet elements moved by a series of gears or belts or some combination of these which are hidden in a base unit underneath the miniature ice pond. Examples of such devices are well described in the following references: U.S. Pat. No. 5,682,692 issued to M. Huang, U.S. Pat. No. 5,915,853 issued to X. Guilin, U.S. Pat. No. 4,177,592 issued to Ruck, U.S. Pat. No. 4,838,825 issued to Hwang and U.S. Pat. No. 2,645,880 issued to M. Richter.

One patent disclosed by the prior art is U.S. Pat. No. 1,323,902 issued to Obolewicz which discloses the use of a base containing motor means and gearing means that makes 4 couples appear to dance in an orbital fashion. This is accomplished through means of worm gears, planetary and orbital gears. But there is no amusing movement in the vertical plane for this device.

Another device shown in the prior art is, U.S. Pat. No. 3,006,111 issued to Koch discloses a music box wherein the drive means for the music box also is used to animate figures through the use of magnets. But this is a very simplistic device with no movement in the vertical plane.

A further patent containing moving figures shown in the prior art is U.S. Pat. No. 5,345,153 issued to Vaught which discloses an ornamental closure with a mechanism and electrical circuitry means which operates the closure and provides music during operation. And, U.S. Pat. No. 5,412,890 issued to Fechter which discloses the use of an animation show with three main rotating bases, and a central larger base which is also provided with rotating figures.

One relatively recent patent shown in the prior art is U.S. Pat. No. 5,713,776 issued to Hou which discloses a magnetic driven device which has a more sophisticated gearing device with motor means, a gearing and drive belts wherein the base magnets are further held within circular rings to produce additional interesting movement. Another patent shown in the prior art is U.S. Pat. No. 5,980,356 issued to Meng-Suen which discloses a magnetic driving mechanism for a moving display unit with slots in drive bars which rotate around a central pivot point to produce a pleasing movement.

A mechanical puppet show is shown in U.S. Pat. No. 6,192,215 issued to Wang which discloses the use servomotors which are provided within a puppet to make the puppet appear to move in a robot like fashion. The puppet is also intended to be audience interactive with a microphone pickup and voice recognition software so that it can move to various user commands. Another interesting patent shown in the prior art is U.S. Pat. No. 6,312,308 issued to Chen which disclosed a motion display toy with a housing cover, hinge means which open the cover when actuated, a telescoping element which extends through the cover opening after it has been opened, and of course music means and light means which are activated when the device initiates operation.

However, no where in the prior art is shown a relatively thin display box with moveable figures which are motor driven in the vertical and/or horizontal plane, which enclosed box may be easily and conveniently removably installed from a standard household window frame.

SUMMARY OF THE INVENTION

The present invention consists of a substantially thin or narrow display box having a translucent front cover, a decorated rear display, two relatively narrow side walls, an upper and lower relatively narrow side enclosure elements, a lower housing containing motor driven means and a set of moveable figurines. In one preferred embodiment of the present invention, moveable figurines are provided in a lower platform, and additional moveable figurines are provided in the vertical plane in front of the decorated rear display. Through a series of slots, the moveable figurines are able to move through a predetermined series of amusing patterns, pleasing to the eye. Electronic music and lights may also provided to effectuate a more interesting appearance of the device.

The present invention is sized such that it may easily sit on the window ledge of a standard household window. Thus, it is preferably sized just a few inches in depth, with a width of approximately 2.5' and a height of no greater than 3.0'. In such a manner, when the appropriate holiday season is near, the user may simply place the device on a window ledge, secure it in a variety of manners to the window frame so that it will not fall or break during use, and then insert batteries or plug the device into an appropriate standard household electric outlet. The user can then switch on music and/or lights or both so that the animated figures contained therein may appear to dance or move in a pleasing fashion. Of course, the device may easily be made weather-resistant so that the user can use the display box out of doors during the holiday season.

In an additional preferred embodiment of the present invention, the display device may be provided with a plurality of interchangeable backgrounds and figures and the user can purchase sets of different backgrounds and figures, depending on the holiday season. For example, one particular set may be provided of moving snowmen and children with a snowy background for Christmas, yet another set which may be purchased may contain nativity figures and a stable background. Still yet an additional set may be purchased with a white background and hearts with faces thereon for Valentine's Day, etc. The user need only open the translucent front cover of the device, place the chosen background on the back of the device, snap on the desired figurines onto pins which move around the device and then the front translucent cover may be replaced and the unit turned on. If music is desired, the user can purchase separate musical modules, containing the desired musical tunes relating to the chosen holiday season, which electronic music modules are provided through a speaker mounted within the housing of the device. A separate outside speaker can be inserted into a jack on the side of the box and dangled out the window though a thin wire, so that the music generation means may be transmitted out the box and out the house, so that the neighborhood or visitors to the home can be easily and conveniently greeted by holiday music.

Of course, the holiday amusement display device may be secured to a standard house double hung window by a variety of means including VELCRO type hook-and-loop fasteners, or miniature hook and loop fastening devices, or suction cups, or a combination of these standard household fastening devices which are commonly used by homeowners so that they do not mar or destroy the surrounding woodwork of a window frame.

In such a manner, a very simple, easy to use and display holiday animated box is shown which can perform and amuse though the various holidays as chosen by the user: Christmas, Easter, St. Patrick's Day, Valentine's Day, $4^{th}$ of July, etc.

OBJECTS OF THE INVENTION

Thus, it is one primary object of the present invention to provide a relatively thin or narrow-depth holiday display amusement device with a variety of moving figurines powered by gears and/or belt drives which can move about the interior of the box.

It is an additional primary object of the present invention to provide a relatively thin or narrow-depth holiday display amusement device which is approximately 2.5' by 3.0' in dimension so that it may be easily and conveniently inserted and removed from a standard household window.

It is still an additional primary object of the present invention to provide a relatively thin or narrow-depth holiday amusement device which is provided with a plurality of moving figurines which are driven by means of a motor and gear means to produce pleasing movement.

A further primary object of the present invention is to provide a relatively thin or narrow-depth holiday amusement device which is provided with a background which is interchangeable or which may be replaced by the user as the holidays change season.

A still further primary object of the present invention is to provide a relatively thin or narrow-depth holiday amusement device which is provided with lighting means within its interior so that the contents of the device may be seen at night through the window glass, if desired by the user.

Yet an additional primary object of the present invention is to provide a relatively thin or narrow-depth holiday amusement device which is provided with music and/or music modules which can be used by the user to provide a plurality of different tunes suitable for the holiday season desired.

Still an additional primary object of the present invention is to provide a relatively thin or norrow-depth holiday amusement device which is provided with a variety of fastening means such as miniature hook and loop fastening devices or elastic looping and removably adhesive hook means so that the device may be easily and conveniently removably installed to the interior surface of a standard home window without marring the wood adjoining the window glass.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
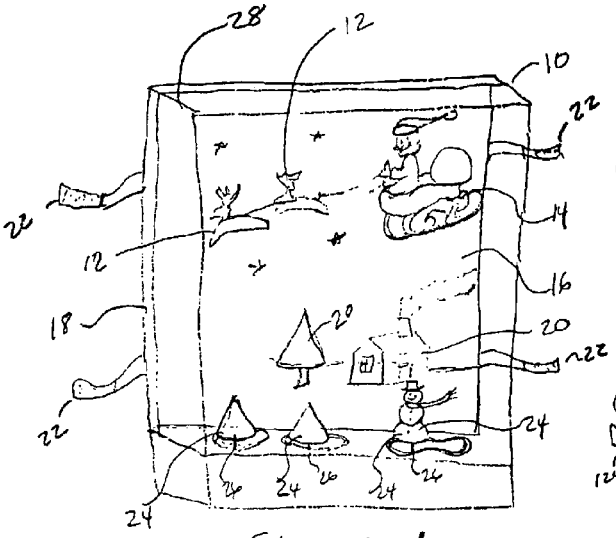
FIG. 1 is a front perspective of the present invention showing the present invention in condition to be installed to the interior surface of a window by means of VELCRO type hook-and-loop fastener strips, or miniature hook and loop fastening devices.

Shown now in FIG. 1 is a preferred embodiment of motion display box 10 in which reindeer characters 10 appearing to be moving across a night sky, pulling a santa character 14. All of these appear to float in front of a decorative background sheet 16 which is removably secured to display box rear wall 18. Accordingly, scenic characters 20 of the house and tree have been imprinted onto decorative background sheet 16. The motion display box 10 is preferably configured to be approximately 3.0" in depth by 3.0' high and 2.5' wide so that it easily fits within the standard window interior of a home. Of course, other sizes and configurations may be used, yet these dimensions are most common for proper display in the interior of a home window. The motion display box 10 may be removably secured to the interior of a home window by using a series of four (4) VELCRO type hook-and-loop fasteners strap members 22 (or other miniature type hook and loop fastening elements). Corresponding VELCRO type hook-and-loop fastener strap members will be secured by the user to the interior of the window frame with a light adhesive, so as not to mar any surface in the home.

In the floor portion of motion display box 10 is provided a set of moving character elements 24 which are placed on pins 26 which, when the device is turned on, appear to move in a predetermined fashion about the interior bottom of the device for the amusement of the user. Because the character elements 24 are merely placed on pins 26, the character elements 24 can be changed from season to season by the user. Motion display box 10 is also provided with a clear translucent front 28 to keep dust off of the figures and prevent children from tampering with the device.

Figure 2:
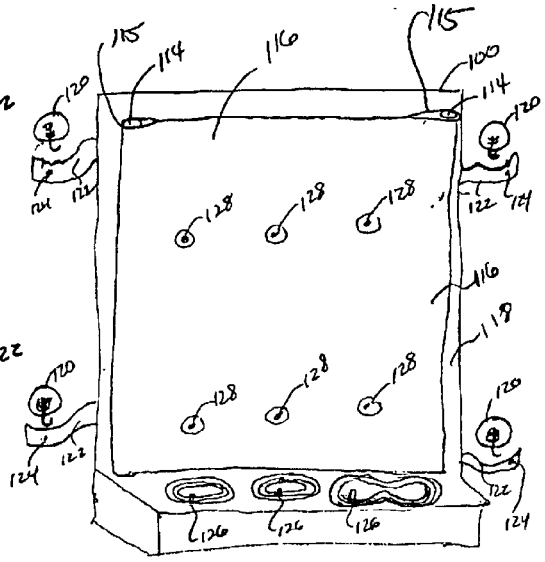
FIG. 2 is a front broken away perspective of the present invention showing the front cover of the present invention removed, as well as the decorative elements removed.

Shown in FIG. 2 is a slightly different version of motion display box 10 in which motion display box 100 is provided with different mounting means. The clear translucent front has been removed as well as all characters from their pins so that additional interior details of the present invention can readily be discerned. In this particular embodiment, the motion display box 100 has been provided with a series of stationary horizontally disposed pins 128 on its vertical rear wall 118, while there are moving pins 126 on the lower platform of the deivce which can move in various configurations, including circular, elliptical or oval as well as irregular shapes. A removable scenic background sheet 116 is also provided which is placed over two vertical rods 114 whenever the user desires to change the scenic background sheet 116 due to a change in holidays. The scenic background sheet 116 is retained on the vertical rods 114 by means of two sleeves 115 disposed along either side of the background sheet 116. In such a circumstance, the characters are removed from their pins and the old scenic background sheet 116 is slipped off the mounting rods 114 through sleeves 116 and is replaced with another scenic background sheet.

Also shown in FIG. 2 is an alternative method of removably installing motion display box 100 to the interior of a home window frame. In this particular embodiment, straps 122 with apertures 124 are provided along the sides of motion display box 100 which may be secured with suction cups 120 to the interior surface of a home window. With such a system, motion display box may be easily secured into to the backside of a home window and then later removed when desired.

Figure 3:
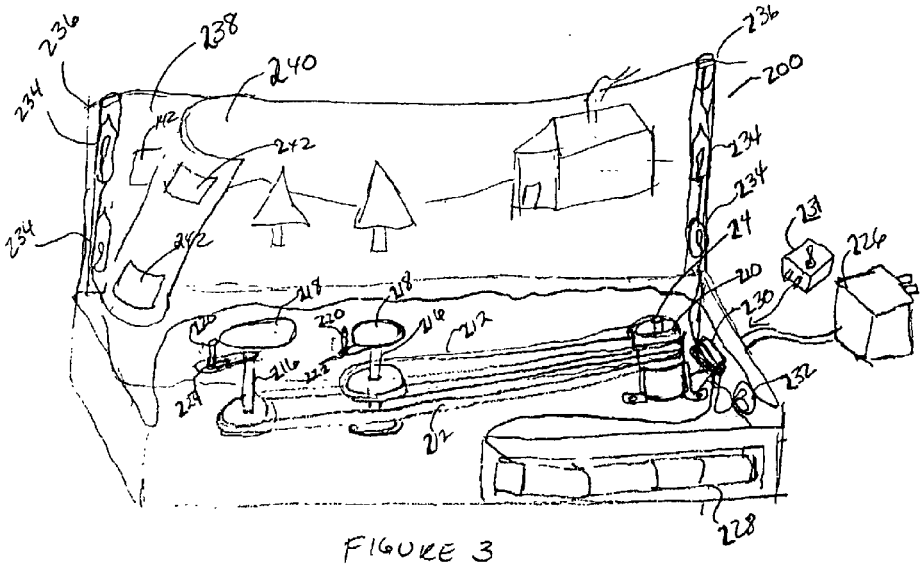
FIG. 3 is a front broken away perspective of the present invention showing the front cover of the present invention removed and showing the interior mechanics of the invention configured for circular and elliptical or oval action of the figures.

FIG. 3 shows the interior contents of the device in a break away view of a slightly modified embodiment of the present invention, motion display box 200. In this particular embodiment, the mechanics for making characters move are clearly evident. An electric motor 210 is provided to provide motion to moving characters of motion display box 200 by a series of elastomeric drive belts 212 which are driven by motor drive shaft 214 which communicates with driven shaft 216 which is attached to stationery arm 222 in the instance where the motion is circular. A character mounting pin 220 is in turn mounted to stationery arm 222. However, where the motion is irregular, such as in the shape of a circle, oval, ellipses or other formation, a slotted arm 224 is used which communicates with a sliding bar which is in turn mounted to mounting pin 220 which the removable character may rest upon. A decorative top element 218 is also provided to hide as much of the space which the mounting pin 220 travels through as the character is moved thereupon. Also shown in FIG. 3 is a transformer plug 226 which is used to step down electric current from 110 V to a smaller charge which is safer when the unit is plugged into an electric outlet. Otherwise, a battery chamber 228 and batteries are provided and may be selected for use by the user when an outlet cannot be conveniently located.

Also provided in this particular embodiment is a music module jack 230 mounted to an interior wall of the device and a removable music module 231 which is electronic and provided with chip means to provide a selected song or series of songs. In such a manner the user can change out the song desired from time to time or as the holidays change. The music module 231 communicates with speaker 232 which is also secured to an interior wall of motion display box 200 and which plays through a series of apertures in provided in a side wall of the interior of the device.

An additional feature of motion display box are a series of miniature lights 234 provided in clear plastic tube 236 along either side of the rear wall 238 of motion display box 200 to provide illumination to the device when it is used at night. Also, an alternative method of removably attaching a scenic background sheet 240 to the rear wall 238 of the device is shown. In this embodiment, a series of VELCRO type hook-and-loop fastener tabs 242 or miniature hook and loop fasteners are utilized to accomplish this objective.

Figure 4:
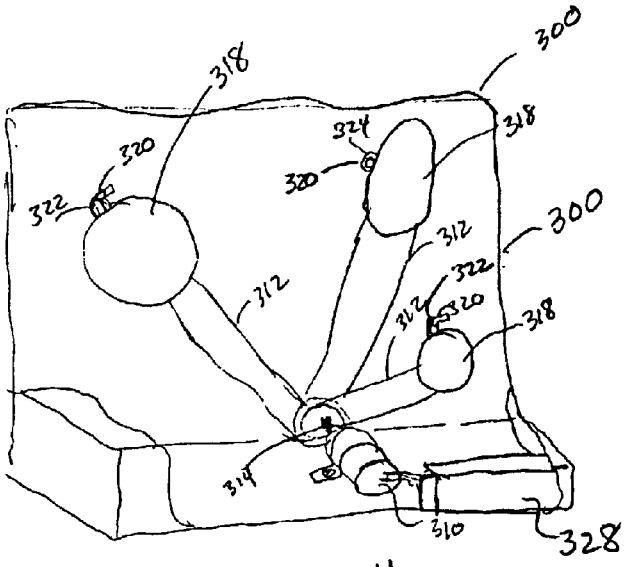
FIG. 4 is a front broken away perspective of the present invention showing the front cover of the present invention removed and showing the interior mechanics of the invention configured for motion of figures in the vertical plane.

FIG. 4 shows an additional preferred embodiment of the present invention, motion display box 300 in a breakaway view in which vertical motion may also be created on the rear wall of the device. Show in this figure are electric motor 310 which communicates with motor drive shaft 314 through a series of elastomeric drive belts 312 to create a spinning motion about mounting pins located in the vertical rear wall of the device. Decorative top elements 318 are used to conceal as much of the path that the pins move through as possible. The rotating mounting pins beneath decorative top elements 318 are attached to either stationery arms 322 or slotted arms 324 depending upon whether the motion desired is circular in nature or irregular in nature. A battery chamber 328 is also provided to provide power to the device motion display box 300.

Figure 5:
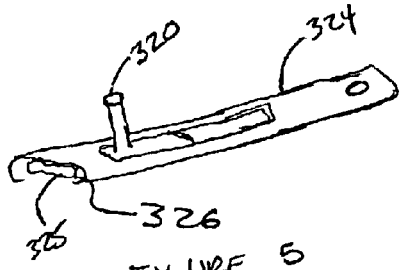
FIG. 5 is a front perspective of the sliding pin element used in irregular motion of figurines for the device.

FIG. 5 shows the detail of sliding bars 324 which are used to produce irregular motion about driven pins. The mounting pin 320 is attached to a bar element 325 which is able to move about freely back and forth in slot 326.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A substantially narrow upright display box having a rear wall, a plurality of substantially horizontally disposed mounting pins attached to the rear wall of the box, a plurality of removable character elements removably attached to each of the horizontal mounting pins, a lower platform, a plurality of substantially vertically disposed mounting pins and a plurality of removable character elements removably attached to each of the vertical mounting pins.

2. The display box of claim 1 further having a decorative thin flexible sheet which is removably secured to the rear wall of the display box.

3. The display box of claim 1 further having removable attachment means to attach the display box to the interior portion of a home window.

4. The display box of claim 3 in which the removable attachment means comprises thin flexible straps and suction cups secured to the thin flexible straps.

5. The display box of claim 3 in which the removable attachment means comprises miniature hook and loop fasteners.

6. The display box of claim 2 in which the decorative sheet further has removable attachment means which is comprised of miniature hook and loop fasteners.

7. The display box of claim 2 in which the display box is further provided with a set of elongate mounting rods directly adjacent its rear wall and the decorative sheet further has removable attachment means which is comprised of a set of sleeves disposed at opposing edges of the sheet and which is capable of communicating with the elongate mounting rods to removably secure the decorative sheet thereto.

8. The display box of claim 1 which is further provided with illumination means.

9. The display box of claim 8 wherein the display box has an interior and the illumination means comprises a plurality of miniature light bulbs disposed about the interior of the display box.

10. The display box of claim 1 which is further provided with music production means to produce a pleasing melody to the user of the device.

11. The display box of claim 10 wherein the music production means comprises electronic chip means and a speaker.

12. The display box of claim 1 further having electric motor means which communicates with a drive shaft and driven shaft to produce motion in the horizontal mounting pins so that the removable character elements move about the display box in a predetermined fashion.

13. The display box of claim 1 further having electric motor means which communicates with a drive shaft and driven shaft to produce motion in the vertical mounting pins so that the removable character elements move about the display box in a predetermined fashion.

* * * * *